US006709320B2

(12) United States Patent
Li

(10) Patent No.: US 6,709,320 B2
(45) Date of Patent: Mar. 23, 2004

(54) WIDTH ADJUSTABLE SHARPENER

(76) Inventor: Sheng Cheng Li, No. 54, Nong 67, Lane 112, Chung Ching Rd., Taichung City (TW)

( * ) Notice: Subject to any disclaimer, the term of this patent is extended or adjusted under 35 U.S.C. 154(b) by 97 days.

(21) Appl. No.: 10/090,717

(22) Filed: Mar. 6, 2002

(65) Prior Publication Data

US 2003/0171083 A1 Sep. 11, 2003

(51) Int. Cl.[7] ..... B24B 23/00

(52) U.S. Cl. ..... 451/349; 451/65; 451/192; 451/193; 451/203; 451/293; 451/298

(58) Field of Search ..... 451/349, 65, 192, 451/193, 203, 196, 202, 198, 293, 298

(56) References Cited

U.S. PATENT DOCUMENTS 4,807,399 A * 2/1989 Friel ..... 451/45
6,012,971 A * 1/2000 Friel et al. ..... 451/45
6,071,181 A * 6/2000 Wightman et al. ..... 451/192
6,368,196 B1 * 4/2002 Bauer ..... 451/293
6,398,633 B1 * 6/2002 Lothe ..... 451/545

* cited by examiner

*Primary Examiner*—Lee D. Wilson
*Assistant Examiner*—Alvin J. Grant
(74) *Attorney, Agent, or Firm*—Charles E. Baxley

(57) ABSTRACT

A knife sharpener includes a handle and an operation portion in which two grinding members are respectively and pivotably received. An aperture is defined through a top of the operation portion and communicates with the grinding members. Each of the two grinding members has a rod extending radially therefrom so as to be engaged with one of two respective spiral grooves of a shaft rotatably received below the grinding members. A positioning member is removably engaged with the shaft. A width between the two grinding members can be adjusted by rotating the shaft.

5 Claims, 4 Drawing Sheets

WIDTH ADJUSTABLE SHARPENER

FIELD OF THE INVENTION

The present invention relates to a knife sharpener that has two pivotable grinding members each of which has a rod pivotably engaged with a shaft, a width between the two grinding members is adjustable by rotating the shaft.

BACKGROUND OF THE INVENTION

A conventional knife sharpener is shown in FIG. 4 and includes a handle 1 and a head 11 in which a V-shaped groove 12 is defined. The two opposite insides 13 of the groove 12 are made by a material that is harder than the material of knives. A blade of a knife (not shown) is inserted in the groove 12 and two sides of the edge of the blade contact the two insides 13 of the groove 12 so that when moving either the blade of the sharpener 1, the edge of the blade is sharpened. Nevertheless, the width of the groove 12 is fixed so that only the blade that has a thickness suitably received in the groove 12 can be sharpened by the sharpener. A knife that has a blade with too thick or too thin blade cannot be sharpened by the sharpener. In other words, the users should prepare at least two sharpeners so as to sharpen all the knives they have.

SUMMARY OF THE INVENTION

In accordance with one aspect of the present invention, there is provided a knife sharpener which comprises a handle and an operation portion in which a chamber is defined so as to receive two grinding members therein. An aperture is defined through a top of the operation portion and communicates with the chamber.

Each of the two grinding members has a grinding surface and an angle is defined between the two respective grinding surfaces. A rod extends radially outward from each of the grinding members.

A passage is defined in the operation portion and a shaft is rotatably received in the passage. Two spiral grooves are defined in an outer surface of the shaft and the two respective rods are engaged with the two spiral grooves. A positioning member is engaged with the shaft.

The primary object of the present invention is to provide a knife sharpener wherein the width between two grinding members can be adjusted so as to sharpen knives with different thickness.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
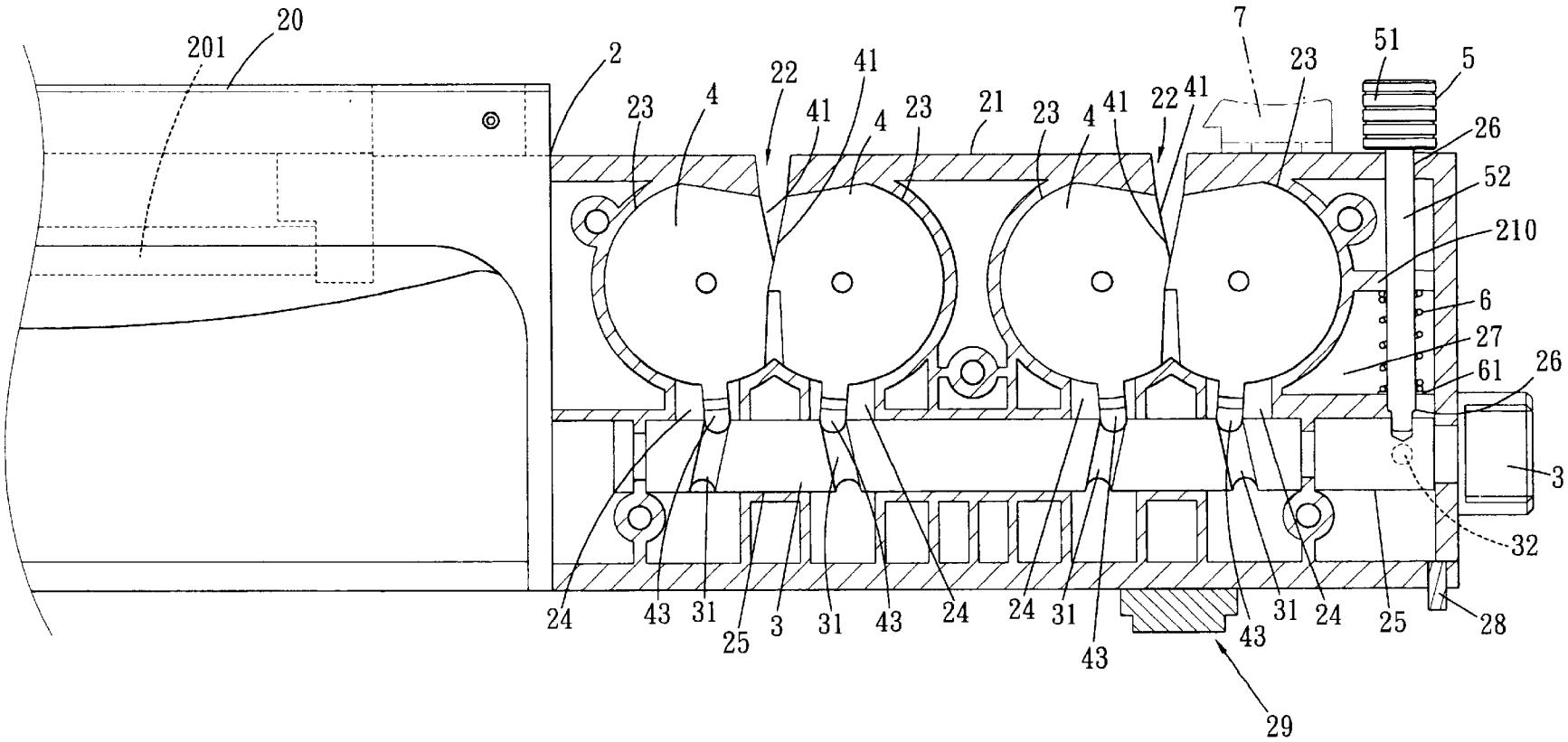
FIG. 1 is a cross sectional view to show the knife sharpener of the present invention.
Figure 2:
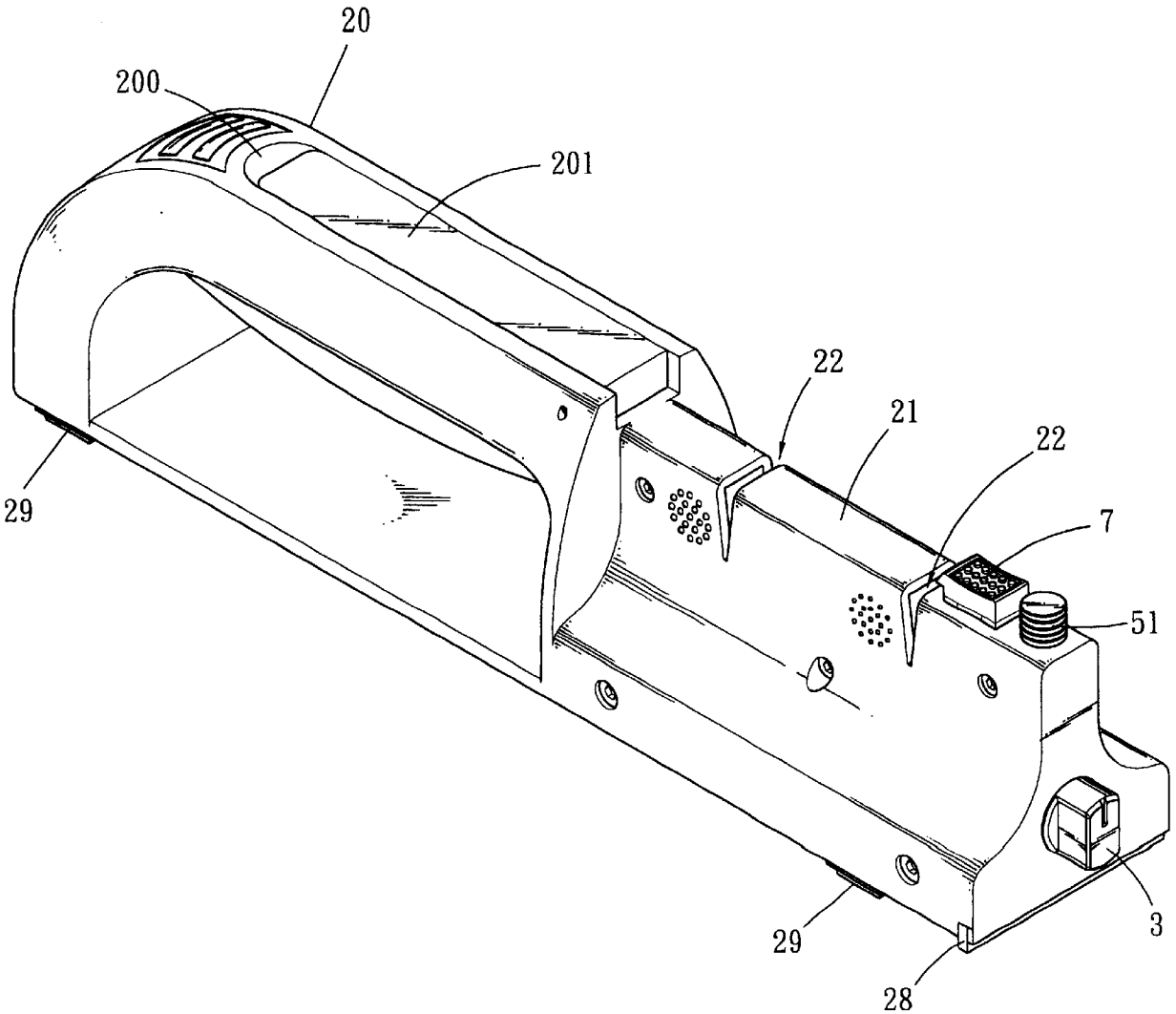
FIG. 2 is a perspective view to show the knife sharpener of the present invention.
Figure 3:
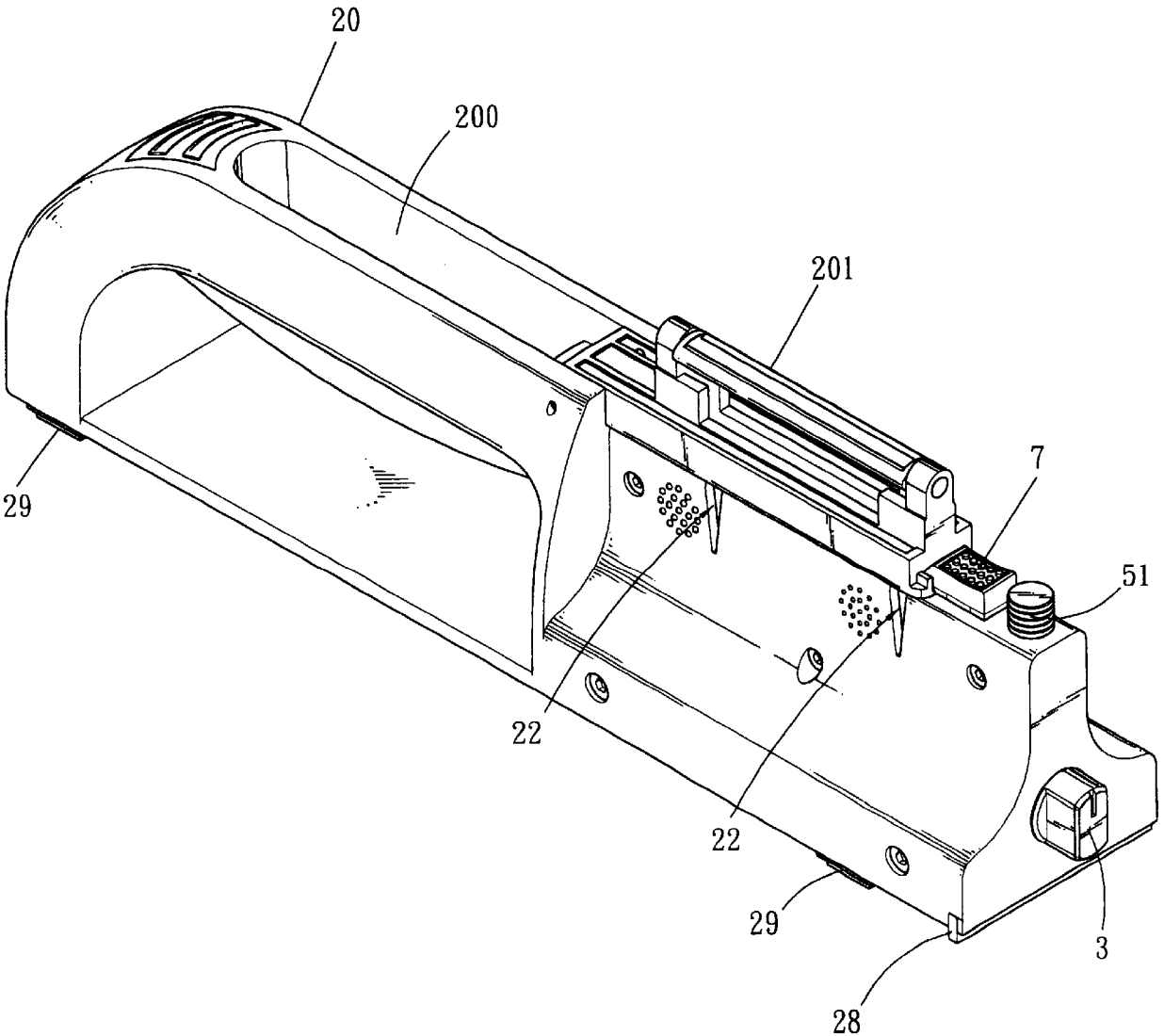
FIG. 3 is a perspective view to show a peeler is engaged with a top of the operation portion of the knife sharpener of the present invention.
Figure 4:
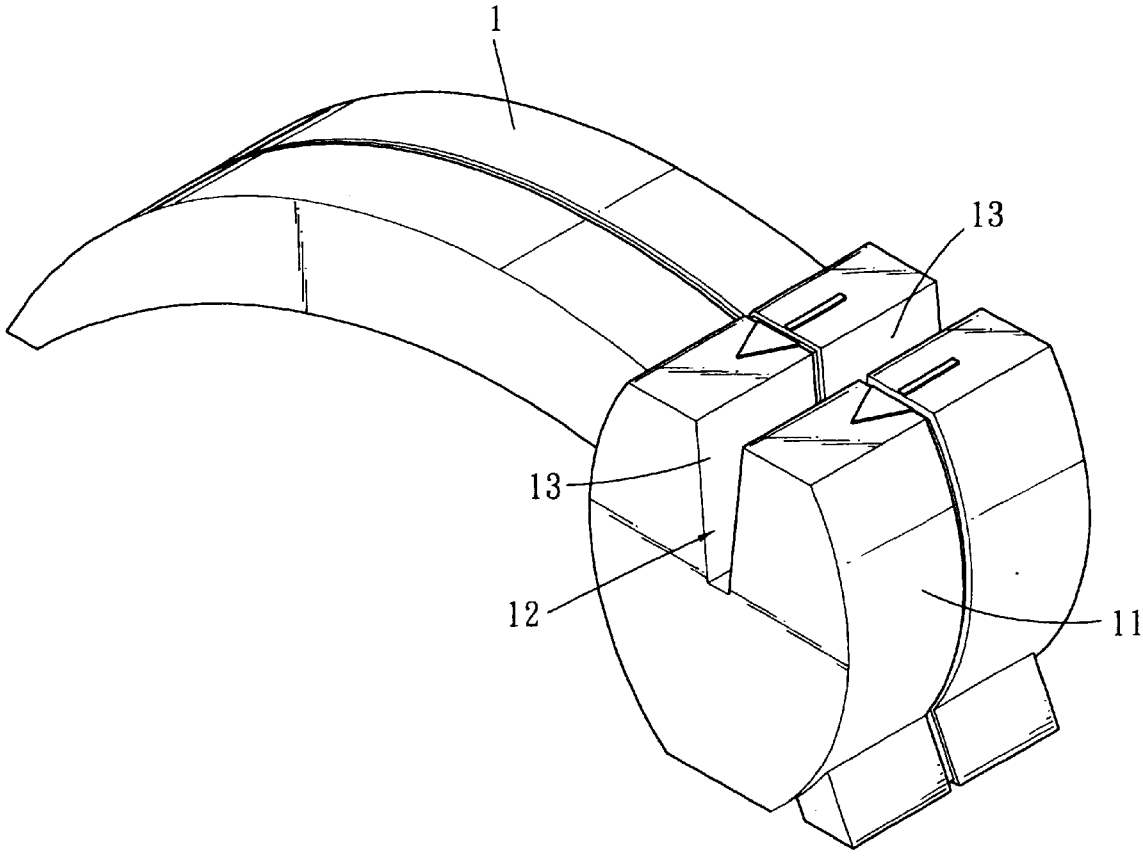
FIG. 4 PRIOR ART
FIG. 4 is a perspective view to show a knife sharpener.

Referring to FIGS. 1 and 2, the knife sharpener 2 of the present invention comprises a handle 20 and an operation portion 21 in which two chamber 23 are defined. Two apertures 22 are defined through a top of the operation portion 21 and communicate with the chambers 23. A receiving chamber 200 is defined in the handle 20 and a peeler 201, for example, is received in the receiving chamber 200. A fastening member 7 is connected on a top of the operation portion 21 so that the peeler 201 can be pivoted out from the receiving chamber 200 and is secured by the fastening member 7 as shown in FIG. 3. The user may hold the handle 20 and peel fruits.

Two grinding members 4 are respectively and pivotably received in each of the chambers 23 and each of the grinding members 4 has a grinding surface 41. The two grinding surfaces 41 face to each other and an angle is defined between the two respective grinding surfaces 41 and communicates with the aperture 22. Therefore, a blade may be put between the two grinding surfaces 41 to be sharpened. Each of the two grinding members 4 has a rod 43 extending radially therefrom.

A passage 25 is defined in the operation portion 21 and a shaft 3 is rotatably received in the passage 25. Two pairs of spiral grooves 31 are defined in an outer surface of the shaft 3. Each of the chambers 23 has a hole 24 which communicates with the passage 25 and the two respective rods 43 extend through the holes 24 and are engaged with the two spiral grooves 31. A knob 3 is connected to an end of the shaft 3 and is accessible from outside of the operation portion 21. Therefore, the user may rotate the shaft 3 by controlling the knob 3. The shaft 3 has a plurality of recesses 32 defined therein.

A positioning member 5 which is a pin extends through a hole 26 defined through the top of the operation portion 21. A clip 61 is secured on the positioning member 5 and a spring 6 is mounted on the positioning member 5. The spring 6 is biased between the clip 61 and an inside 210 of the operation portion 21. A lower end of the positioning member 5 is received in one of the recesses 32 to position the shaft 3. When the positioning member 5 is lifted to remove the lower end of the positioning member 5 from the recess 32, the shaft 3 is able to be rotated. The rods 43 of the grinding members 4 are then shifted and the grinding members 4 are rotated to adjust the angle and the width between the two grinding surfaces 41 so as to fit different thickness of knives.

Two support legs 29 are connected to an underside of the sharpener 2 and a grinding piece 28 is connected to an underside of the operation portion 21. A lower end of the grinding piece 28 is shorter than the support legs 29. The grinding piece 28 allows the user to have different options to sharpen knives.

While we have shown and described the embodiment in accordance with the present invention, it should be clear to those skilled in the art that further embodiments may be made without departing from the scope of the present invention.

What is claimed is:

1. A knife sharpener comprising:

a handle and an operation portion in which a chamber is defined, an aperture defined through a top of the operation portion and communicating with the camber;

two grinding members respectively received in the chamber and each of the two grinding members having a grinding surface, an angle defined between the two respective grinding surfaces and communicating with the aperture, each of the two grinding members having a rod extending radially therefrom;

a passage defined in the operation portion and a shaft rotatably received in the passage, two spiral grooves defined in an outer surface of the shaft and the two respective rods engaged with the two spiral grooves, and a positioning member engaged with the shaft, the positioning member is a pin extending through the operation portion and the shaft has a plurality of recesses, a lower end of the positioning member received in one of the recesses.

2. The sharpener as claimed in claim 1, wherein a spring is mounted on the positioning member and a clip is secured on the positioning member, the spring biased between the clip and an inside of the operation portion.

3. The sharpener as claimed in claim 1 further comprising a receiving chamber defined in the handle and a peeler received in the receiving chamber.

4. The sharpener as claimed in claim 3 further comprising a fastening member connected on a top of the operation portion so as to secure the peeler in the receiving chamber.

5. The sharpener as claimed in claim 1 further comprising a grinding piece connected to an underside of the operation portion;

two support legs connected to an underside of the sharpener and a lower end of the grinding piece being shorter than the support legs.

* * * * *